US012565355B2

(12) United States Patent
Saviano

(10) Patent No.: US 12,565,355 B2
(45) Date of Patent: Mar. 3, 2026

(54) CONTAINER AND CUP SEPARATOR

(71) Applicant: Thomas A. Saviano, Belmont, CA (US)

(72) Inventor: Thomas A. Saviano, San Mateo, CA (US)

(73) Assignee: Thomas Saviano, Belmont, CA (US)

( * ) Notice: Subject to any disclaimer, the term of this patent is extended or adjusted under 35 U.S.C. 154(b) by 0 days.

(21) Appl. No.: 18/237,382

(22) Filed: Aug. 23, 2023

(65) Prior Publication Data

US 2025/0066074 A1 Feb. 27, 2025

(51) Int. Cl.
*B65D 21/02* (2006.01)

(52) U.S. Cl.
CPC ..... *B65D 21/0224* (2013.01)

(58) Field of Classification Search
CPC ..... B65D 21/0224; B65D 21/0233
USPC ..... 206/514
See application file for complete search history.

(56) References Cited

U.S. PATENT DOCUMENTS 1,383,779 A * 7/1921 Workman ..... A47J 36/34 206/514
3,358,878 A * 12/1967 Ostborg ..... A47G 19/23 206/821
3,547,309 A * 12/1970 Pusey ..... B65D 21/0235 220/23.6
2008/0105584 A1* 5/2008 Cecil ..... B65D 21/0224 220/729
2023/0021318 A1* 1/2023 Campbell ..... B65D 81/05

* cited by examiner

*Primary Examiner* — Stephen J Castellano
(74) *Attorney, Agent, or Firm* — Haynes Beffel & Wolfeld LLP; Andrew L. Dunlap; Hannah Powell

(57) ABSTRACT

The disclosed apparatus is configured to reduce the force necessary to separate a container from a nested stack of two or more containers, wherein the disclosed apparatus comprises a partition configured to modify at least one area of contact between an inner container and an outer container within a nested stack. The partition may adjust the size or location of the area of contact itself, or adjust the properties of one or more forces exerted upon the area of contact. The partition may be configured to further comprise additional supporting structures, such as a lower support member or via hole to provide additional support for the inner container.

19 Claims, 8 Drawing Sheets

CONTAINER AND CUP SEPARATOR

FIELD OF THE TECHNOLOGY DISCLOSED

The technology disclosed generally relates to a container and cup separator, and relates more specifically to a container and cup separator comprising a platform to hold the bottom of an inner container or cup within a stacked pair of an inner container or cup and an outer container or cup, to prevent the inner container or cup from dropping down into the bottom of the outer container or cup.

BACKGROUND

The subject matter discussed in this section should not be assumed to be prior art merely as a result of its mention in this section. Similarly, a problem mentioned in this section or associated with the subject matter provided as background should not be assumed to have been previously recognized in the prior art. The subject matter in this section merely represents different approaches, which in and of themselves can also correspond to implementations of the claimed technology.

A variety of containers such as buckets, storage bins, food storage containers, and cups are designed to be stackable in a manner allowing for two or more containers to be nested. Such structural designs provide a compacted form of storage for the containers (often in scenarios where the containers are not in use), enabling a user to rest one container inside of another, building a stack of two or more nested containers. Certain containers may provide a lipped edge around the top perimeter of the container, or a handle from which to grasp, lift, or carry the container. Containers both possessing and lacking these structural components still carry a risk of becoming stuck together and difficult for a user to separate.

Containers with highly similar geometry may potentially become difficult to separate as a result of physical forces such as elasticity, friction, and air pressure. Regardless of geometry, a smaller container nested inside of a larger container may also become difficult to separate as a result of poor contact angle between the inner and outer container or lack of leverage provided to an arm or mechanical object attempting to retrieve the inner container.

An opportunity arises for a container and cup separator that solves the above-described problems.

SUMMARY

The technology disclosed relates to an apparatus configured to reduce a force necessary to separate a container from a nested stack of two or more containers, wherein the apparatus includes a partition that is configured to modify at least one area of contact between an inner container and an outer container. When the disclosed apparatus (also referred to herein as a container and cup separator) is installed, the inner container is nested inside of the outer container with the partition located between an outer wall of the inner container and an inner wall of the outer container. In many implementations, the partition modifies the area of contact by restricting one or more size dimensions of the area of contact, adjusting a location of the area of contact, reducing a magnitude of force exerted onto the area of contact, and/or altering one or more properties related to absorption or distribution of a force exerted onto the area of contact. The apparatus can be configured to be inserted into the outer container before the inner container is inserted into the outer container as a preventative measure to reduce a potential force necessary for separation before the nested stack is constructed.

Many implementations disclosed relate to an apparatus that is configured to be inserted in between the outer container and the inner container within a previously nested stack as a fixative measure to reduce a realized force necessary for separation after the nested stack is constructed. The apparatus can include one or more connection components that are configured to receive and be supported by an uppermost surface or rim of the outer container. The apparatus can further include a lower support member configured to provide additional support for the inner container in by at least one of (i) providing additional partitioning of the inner container and the outer container, (ii) restricting a depth of insertion for the inner container into the outer container, and/or (iii) maintaining a level alignment of the inner container, according to some implementations of the technology disclosed.

In certain implementations, the lower support member of the apparatus is a triangular support. In other implementations, the lower support member of the apparatus is a rectangular support. In yet other implementations, the lower support member of the apparatus is a circular support. Some described variations, in accordance with various implementations of the disclosed apparatus, further comprise one or more via holes configured to hold a peg, wherein the peg is any structure inserted within a via hole, and when the apparatus is installed, the peg provides support for the inner container to stop insertion of a bottom of the inner container within the outer container.

The partition of the disclosed apparatus can modify the area of contact by restricting one or more size dimensions of the area of contact, adjusting a location of the area of contact, reducing a magnitude of force exerted onto the area of contact, and/or altering one or more properties related to absorption or distribution of a force exerted onto the area of contact.

In certain implementations of the disclosed apparatus, the partition includes a lower end configured to be located near a bottom portion of an inside portion of the outer container and an upper end configured to be located near a top portion of the inside portion of the outer container. The apparatus can further include a first upper support member extending from the upper end of the partition, such that, when the apparatus is installed, the first upper support member is supported by a top rim of the outer container. In one implementation, the upper end of the partition and the first upper support member form an L-shaped structure, such that the first upper support member is a shorter portion of the L-shaped structure, and the partition is a longer portion of the L-shaped structure. In another implementation, the upper end of the partition and the upper support member form an angle between 80 and 100 degrees, inclusive.

The disclosed apparatus may further include a second upper support member extending from the first upper support ember, such that the upper end of the partition, the first upper support member and the second upper support member form a U-shaped structure and such that, when the apparatus is installed, the top rim of the outer container is located in a first support area formed by the upper end of the partition, the first upper support member and the second upper support member. The first upper support member and the second upper support member can form an angle between 80 and 100 degrees, inclusive, such that the second upper support member and the partition extend along non-transverse planes and the first upper support member extends along a plane that is transverse to the planes upon which the second upper support member and the partition extend, in accordance with one implementation of the technology disclosed.

The disclosed apparatus, in some implementation, further comprises a lower support member extending from the lower end of the partition, such that, when the apparatus is installed, the lower support member receives a bottom portion of the inner container to prevent further insertion of the bottom portion of the inner container. In one implementation, the apparatus includes a lower support member extending from the lower end of the partition, such that, when the apparatus is installed, the lower support member receives a bottom portion of the inner container to prevent further insertion of the bottom portion of the inner container. The lower end of the partition and the lower support member can form an angle between 80 and 100 degrees, inclusive.

The apparatus can further include one or more via holes located in the partition, wherein the one or more via holes are configured to receive a peg that forms a lower support member, such that, when the peg and the apparatus are installed, the lower support member receives a bottom portion of the inner container to prevent further insertion of the bottom portion of the inner container, in many disclosed implementations.

The technology disclosed also relates to a method of installing an apparatus that separates an inner container and an outer container, the apparatus including a partition comprising (i) a lower end configured to be located near a bottom portion of an inside portion of the outer container and (ii) an upper end configured to be located near a top portion of the inside portion of the outer container, and including a first upper support member extending from the upper end of the partition, a second upper support member extending from the first upper support member, such that the upper end of the partition, the first upper support member and the second upper support member form a U-shaped structure and a lower support member extending from the lower end of the partition. The method further includes installing the apparatus by placing a first support area formed by the U-shaped structure on an upper rim of the outer container, such that at least a portion of the partition and the lower support member are located inside the outer container and such that the first upper support member is in contact with and supported by the upper rim of the outer container, and placing the inner container within the outer container, such that an outer wall of the inner container is in contact with the partition which forms an air gap between an inner wall of the outer container and the outer wall of the inner container and such that a bottom portion of the inner container is in contact with and supported by the lower support member.

Some implementations of the method further involve installing a second apparatus including a partition comprising (i) a lower end configured to be located near a bottom portion of an inside portion of the outer container and (ii) an upper end configured to be located near a top portion of the inside portion of the outer container, and including a first upper support member extending from the upper end of the partition, a second upper support member extending from the first upper support member, such that the upper end of the partition, the first upper support member and the second upper support member form a U-shaped structure and a lower support member extending from the lower end of the partition. The second apparatus can be installed prior to the placing of the inner container within the outer container and, by placing a first support area of the second apparatus formed by the U-shaped structure of the second apparatus on an upper rim of the outer container, such that at least a portion of the partition of the second apparatus and the lower support member of the second apparatus are located inside the outer container and such that the first upper support member of the second apparatus is in contact with and supported by the upper rim of the outer container.

BRIEF DESCRIPTION OF THE DRAWINGS

In the drawings, like reference characters generally refer to like parts throughout the different views. Also, the drawings are not necessarily to scale, with an emphasis instead generally being placed upon illustrating the principles of the technology disclosed. In the following description, various implementations of the technology disclosed are described with reference to the following drawings.

DETAILED DESCRIPTION

Figure 1:
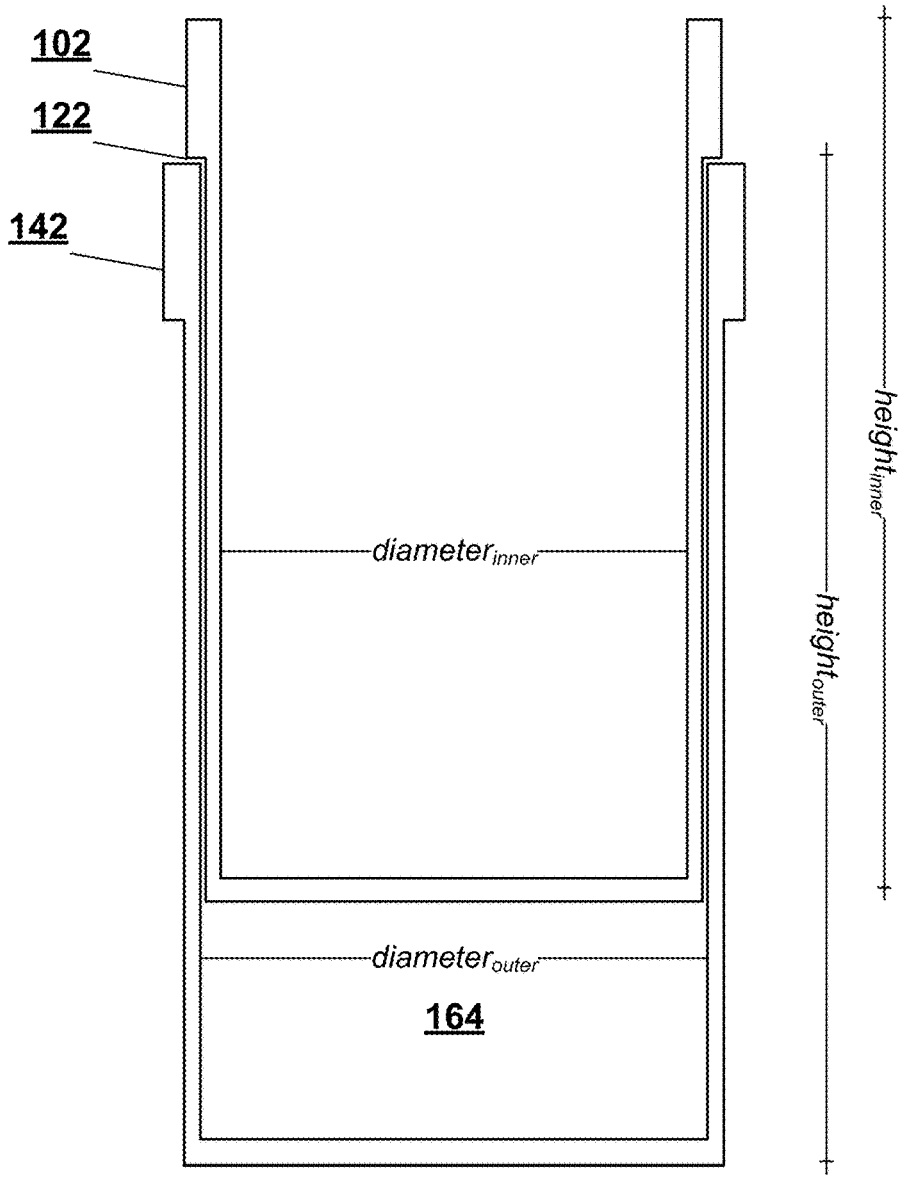
FIG. 1 is a schematic illustration of a pair of nested containers in a stack.

The following detailed description is made with reference to the figures. Sample implementations are described to illustrate the technology disclosed, not to limit its scope, which is defined by the claims. Those of ordinary skill in the art will recognize a variety of equivalent variations on the description that follows.

Introduction

Motivation

Containers used for the storage and transportation of various items are commonplace in most, if not all, personal and professional aspects of life. The average home is likely to include some form of cup-shaped containers, such as cups and bowls used for consuming, measuring, or storing food and drink. A limitless number of use cases exist in both the home and workplace for storage bins and containers, such as rectangular totes or cylindrical buckets for the containment, storage, or transport of items. Herein, the word "container" will be used as an umbrella term that is to be understood as synonymous with a plurality of container types such as containers, totes, crates, cups, bowls, buckets, and so on. The development of nestable containers designed to withstand form and structure while inserted inside one another, creating a neatly-fitted stack, has improved the efficiency of storing such containers.

For one object to stably nest within another such that the stack is stable, buildable (i.e., a first container has a second container nested inside of it, the second container has a third container nested inside of it, and so on), and easily separable, the objects must have one or more overlapping features in both shape and size. If a set of two or more containers possesses too much variation in size or shape, a nested stack of the containers may lack balance, produce uneven pressure on a particular region of one or more nested containers within the stack causing damage, or result in an unwieldy pile of containers that takes up space in an inconvenient manner. The above-described issues arguably reduce the benefit of nesting the containers.

Paradoxically, while containers form nested stacks more easily as the similarity between size and shape of the containers increases, increasing the similarity of container size and shape also increases the risk that the nested containers may become stuck together and difficult to separate also increases, decreasing the utility of the nesting function. Many designs comprise a structural component that can assist with tightly joined containers, such as the indented handle on certain storage totes and the affixed wire handle on certain buckets. However, the physical forces responsible for cementing two nested containers together frequently become too strong for an individual to easily separate, even using these structural components for assistance.

Classical Mechanics and the Separation of Nested Objects

Nested objects within a stack become resistant to separation as a result of frictional forces. Friction is a force resisting relative motion that occurs at the interface between objects or molecules. A variety of factors affect the magnitude of pressure between surfaces in contact, such as the adhesion between surfaces at points of contact, the texture of the surfaces in contact, and the deformation of the surfaces. The surfaces of all objects, such as nested containers, contain some extent of asperity (i.e., roughness) on a microscopic level, even if the surfaces appear to be smooth. As a result, the resulting area of contact between two surfaces is not consistent-individual asperity "peaks" make up the effective area of contact.

Pressure is equivalent to the amount of force exerted per unit of area. At constant force, the pressure between two surfaces is inversely related to the area of effective surface contact. Thus, the pressure at the small areas of contact between the asperities of each surface is very high. The extreme pressure results in cold welding at the molecular level and adhesion between the two surfaces. For the surfaces to move relative to each other, sufficient force greater than the adhesive force must be applied. Moreover, interlocking areas can form between the surfaces where the asperities of one surface settle into the valleys of the other surface, and these interlocked surfaces must be broken or deformed (e.g., via elastic forces influencing the contraction and expansion of the surfaces) in a process known as abrasion. Overcoming the static friction between two surfaces and producing movement requires overpowering both the adhesion and abrasion contributing to the frictional force with a sufficient opposite force.

Increased applied force exerted upon a region of an object will proportionally increase the pressure applied upon the area, and in turn, greater pressure between two surfaces causes an increase in frictional force. The magnitude of force pressing two surfaces closer together is influenced by orientation in space (i.e., the extent to which a force is working with or against the force of gravity), relative orientation and angle of the force, the elasticity of the surface, the dilatancy of the surface material, air pressure, and any resulting pressure differential occurring as a consequence of the interaction between the surfaces. A person skilled in the art will recognize that these forces are listed explicitly as examples, and the complete and total scope of forces acting upon objects in space is substantially more complex.

Properties of Nestable Containers Influencing Separation

In certain manufacturing processes, containers are injection-molded, meaning the material is formed with a slight "draft angle" or taper, to the sides, allowing for a container to be removed from the mold in which it was formed. Intuitively, the draft angle also positively contributes to the nesting capacity of a container. As an example, many commercial buckets used in manual labor operations are manufactured using injection molding. The wall thickness of the bucket is typically constant throughout to provide structural stability, and consequently, the outside layer draft angle exactly matches the inside layer draft angle of the bucket. Thus, if a pair of nestable buckets produced on the same size and style of mold are stacked, the outer draft angle of the inner bucket and the inner draft angle of the outer bucket will be the same. Hence, the outer surface of the inner bucket and the inner surface of the outer bucket share a high geometric similarity and therefore are capable of developing a large area of contact with one another. As a result, a high degree of mutual friction occurs between the pair of buckets (i.e., the nested buckets firmly adhere to one another) and a tension force with greater magnitude relative to the friction force must be applied to the nested buckets to separate them. Furthermore, the forces exerted upon a stack of nested buckets increase proportionately to the mass and quantity of buckets within the stack, as well as synergistically with gravitational forces upon a vertical stack. Pressure between buckets within the stack may also increase as a result of temperature increases.

When forces are applied to any two nested objects in the appropriate direction and magnitude to push the two objects closer together, the volume of the area between the objects is decreased. As the volume of an area between objects decreases, air is forced out from the cavity between the objects, reducing pressure within the cavity. The resulting pressure differential between the atmospheric pressure and the much lower pressure in the cavity creates a partial vacuum, such that the higher-pressure surrounding air will exert a force relative to the lower-pressure space in between the objects. A nested pair of buckets pressed into each other will force out the air between the inner and outer buckets, creating a partial vacuum. The force exerted upon the low-pressure partial vacuum in between the inner and outer bucket will create suction. The increased force against a constant area results in increased pressure and subsequently, also results in increased frictional force resisting motion between the bucket surfaces in contact.

Consider the analogous example of a suction cup, whereby pressing a suction cup against a surface reduces the volume under the suction cup, forcing air molecules out and reducing pressure. The resulting pressure differential between the atmosphere outside of the suction cup and the cavity inside the pressure cup forces the cup against the surface, much like the way a partial vacuum seal between nested buckets strongly holds the nested buckets together.

Many strategies and instructional guides are widely available to solve the frequent dilemma of a pair of nested containers resisting separation. However, the majority of this advice is inconvenient for an individual to employ, produces unreliable results, or a combination of both. Individuals faced with tightly-interlocked containers (such as buckets, bowls, and cups) may come across suggestions to separate the containers including application of a lever in between the containers to partially break the seal and pry the containers apart, applying heat to the outside of the containers (and occasionally, cold to the inside of the containers) to create a temperature gradient, use of a suction cup to apply an opposite force against the containers, or attempting to place liquid in between the containers to decrease friction. The above-described methods risk damage to the containers via stretching, cracking, chipping, or shattering one or more containers within a tightly nested stack. More cautious methods can take extended amounts of time, and it is difficult to predict the length of time in which one could expect the necessary transformation to occur for the buckets to separate. As a result, the difficult separation of tightly nested containers costs frustration, the financial cost to replace containers that are either too difficult to separate or experience damage in the process of separation, and the time of separating containers that have become stuck.

The described problem of nested containers that are difficult to separate is not limited to the realm of containers that are designed to be nested, containers that are designed such that containers are only intended to nest with other containers with an equal size or shape, or containers that do not share highly similar geometry, size, surface pattern, et cetera. Containers comprising a hollow inner cavity may be stacked and nested within each other in suboptimal configurations that can also potentially result in nested containers that are difficult to separate. Consider a much larger container placed partially inside of a smaller container exhibiting elastic collision such that the smaller container is forced to expand to accommodate the larger container, tightening as it contracts following a decrease in force. Alternatively, it can be difficult to retrieve a smaller inner bucket from a larger outer bucket if the tool used to retrieve the inner bucket does not have sufficient reach. In a final example, when one container surface region meets another, highly-incongruent container surface region, the highly concentrated force applied to the limited area of surface contact may adhere the two containers together in lieu of global geometric similarity.

The above risk factors for tightly-interlocked containers that become difficult to separate do not exist in isolation and a combination of forces may hold two containers together. Due to the wide range of variables influencing the separability of nested containers, and the prevalence of nested stacking of containers for efficient space usage, a need is present for an apparatus capable of improving the separability of containers in an efficient and safe manner.

The technology disclosed comprises an apparatus for separating nested containers via forming a partition between adjacent nested containers, therefore decreasing the risk of an excessive force being generated such that the nested containers are tightly adhered together and resist separation. Herein, an "excessive force" is defined as the combined direction and magnitude of one or more forces exerted upon a pair of buckets, directly or indirectly, such that the equal and opposite force required to separate the pair of buckets consumes a detrimental level of mental or physical strain, time, or money on behalf of the separator.

Proof of Concept: Orientation of Nested Containers Within a Stack

The physical and chemical properties influencing the attachment and detachment of nested objects, such as a stack of containers, will now be applied specifically to a series of technical proof-of-concept example scenarios involving the nesting of a pair of containers into a vertical stack.

FIG. 1 is a schematic illustration 100 of a pair of nested containers in a stack. Illustration 100 illustrates an inner container 102 inserted into outer container 142, such that the pair of containers forms a nested stack. For simplicity, assume that inner container 102 and outer container 142 possess a highly-similar draft angle and no additional complex surface features exist upon the inside or outside surface of either container. Inner container 102 can be described by its respective diameter ("$\text{diameter}_{inner}$") and height ("$\text{height}_{inner}$"). Likewise, outer container 142 can be described by its respective diameter ("$\text{diameter}_{outer}$") and height ("$\text{height}_{outer}$"). The nesting arrangement of inner container 102 and outer container 142 can be described by a plurality of characteristics such as the lid contact point 122, the nesting (draft) angle, and the hollow cavity 164 that fills the space in between the bottom of inner container 102 and the bottom of outer container 142.

Although a plurality of additional measurements can be employed to describe the nested stack of inner container 102 and outer container 142, certain details are intentionally omitted for clarity. For outer container 142 to adequately support inner container 102, some extent of contact between the two containers is necessary. Depending on the geometry of each respective container, this area of contact may be restricted to the vertical walls of the containers or may also extend to the bottoms of the containers. The extent of contact will be influenced by the respective heights, diameters, and draft angles of each respective container. Assume that inner container 102 and outer container 142 have been manufactured with a positive draft angle to allow for detachment of the container from a mold or another nested container; hence, the diameter of each respective container will be largest at the superior rim of the container and taper off as the container wall approaches the inferior base.

Inner container 102 can be inserted into outer container 142 until it reaches a point of resistance. In one scenario, the point of resistance may be once inner container 102 reaches a point at which a particular $\text{diameter}_{inner}$ at a particular $\text{height}_{inner}$ encounters a smaller particular $\text{diameter}_{outer}$ at a particular $\text{height}_{outer}$, such that inner container 102 no longer has sufficient space to move deeper into outer container 142. The depth level at which a point of resistance is reached can be determined if the respective heights, diameters, and draft angles of inner container 102 and outer container 142 are known. If $\text{height}_{inner}$ and $\text{height}_{outer}$ are comparable and lid $\text{diameter}_{inner}$ and lid $\text{diameter}_{outer}$ are comparable, but inner container 102 has a larger draft angle than outer container 142, inner container 102 will hit a point of resistance at a shallower depth within outer container 142. If $\text{height}_{inner}$ and $\text{height}_{outer}$ are comparable and lid $\text{diameter}_{inner}$ and lid $\text{diameter}_{outer}$ are comparable, but inner container 102 has a smaller draft angle than outer container 142, inner container 102 will hit a point of resistance at a deeper depth within outer container 142. As $\text{height}_{inner}$ increases relative to $\text{height}_{outer}$ or $\text{diameter}_{inner}$ increases relative to $\text{diameter}_{outer}$, the extent to which inner container 102 can be inserted into outer container 142 without meeting resistance diminishes proportionately.

Moreover, the differential between the respective draft angle of inner container 102 and outer container 142 determines the surface area of the point of resistance. In the described scenarios wherein the draft angle differential between inner container 102 and outer container 142 is nonzero (i.e., the respective vertical walls of each container are not parallel), the region of contact between the respective vertical walls is limited proportional in magnitude to the absolute magnitude of the draft angle differential. Analogously, a pair of closely-proximate two-dimensional functions on a three-dimensional plane may have a single, distinct point of intersection if the relative angle between the functions is large. However, as the relative angle between the functions narrows, the degree of osculation (order of contact) increases. Likewise, when $height_{inner}$ and $height_{outer}$ are comparable, lid $diameter_{inner}$ and lid $diameter_{outer}$ are comparable, and the respective draft angle of each container is also comparable, a large surface area of contact is possible between the pair of nested containers.

As the point of contact between inner container 102 and outer container 142 shrinks (i.e., the area upon which force is applied), the magnitude of pressure at the point of contact increases. The magnitude of pressure at the point of contact directly increases relative to the magnitude of force applied to the pair of buckets at the point of contact. The magnitude of force applied may be amplified by the applied force of the entity stacking the containers, the mass of the containers, physical properties of the containers such as elasticity, and the angle at which force being applied. Consequently, the tensional force necessary to separate inner container 102 and outer container 142 increases as the magnitude of pressure increases.

Alternatively, as the point of contact between inner container 102 and outer container 142 expands (i.e., the area upon which force is applied), the pressure is applied in an increasingly diffuse manner, weakening the overall magnitude of pressure as magnitude of force remains constant. Nevertheless, as the point of contact expands, the surface onto which frictional forces and adhesional forces are applied expands. If inner container 102 and outer container 142 are sufficiently geometrically similar, the pair of containers may become essentially flush with each other upon nesting. Consequently, large amounts of mutual friction resisting movement between the containers must be overcome to separate the nested stack.

If a point of resistance is met as inner container 102 is inserted into outer container 142 with sufficient force, a partial seal is able to form and prevent airflow between cavity 164 and the surrounding air. A partial vacuum may result if the pressure differential is great enough, introducing additional forces via suction. As shown in illustration 100, inner container 102 and outer container 142 comprise a lip at the opening of each respective container. Contact between the respective lip of each container, as shown at point 122, may assist in preventing inner bucket 102 from sinking deep enough within outer container 142 to reach a high-pressure contact point between the bottom of inner container 102 and the vertical wall of outer container 142 while nested. Nevertheless, contact between the lids at point 122 may contribute to the difficulty of separation if the lids are allowed to form a seal or become wedged together by the applied force.

For any above-described scenario, a sufficient increase in temperature after the point at which inner container 102 is nested inside of outer container 142 may result in the expansion of at least one respective container, exacerbating any forces resisting separation.

As made apparent by the scenarios explored, an optimal balance of contact exists to minimize the risk of excessive forces resisting the separation of inner container 102 and outer container 142. As made additionally apparent by the scenarios explored, the physics and engineering factors involved in this optimal balance are complex and highly specific to the particular characteristics of a given inner container 102 and a given outer container 142. These factors are not only inconvenient for the average consumer to consider, the degree of control one has over these factors post-manufacturing is limited. Accordingly, sufficient evidence exists to demonstrate a high risk of resistance to separation within nested stacks of containers that is inherent to the process of nesting, justifying a need for an apparatus preventing inner container 102 from becoming stuck inside the outer container 142.

The discussion thus far has described evidence that a scenario in which a stack of nested containers requires excessive force to separate a container from the stack in a theoretical manner. Now, a plurality of example scenarios are briefly described to provide context for the above-described phenomena.

Figure 2:
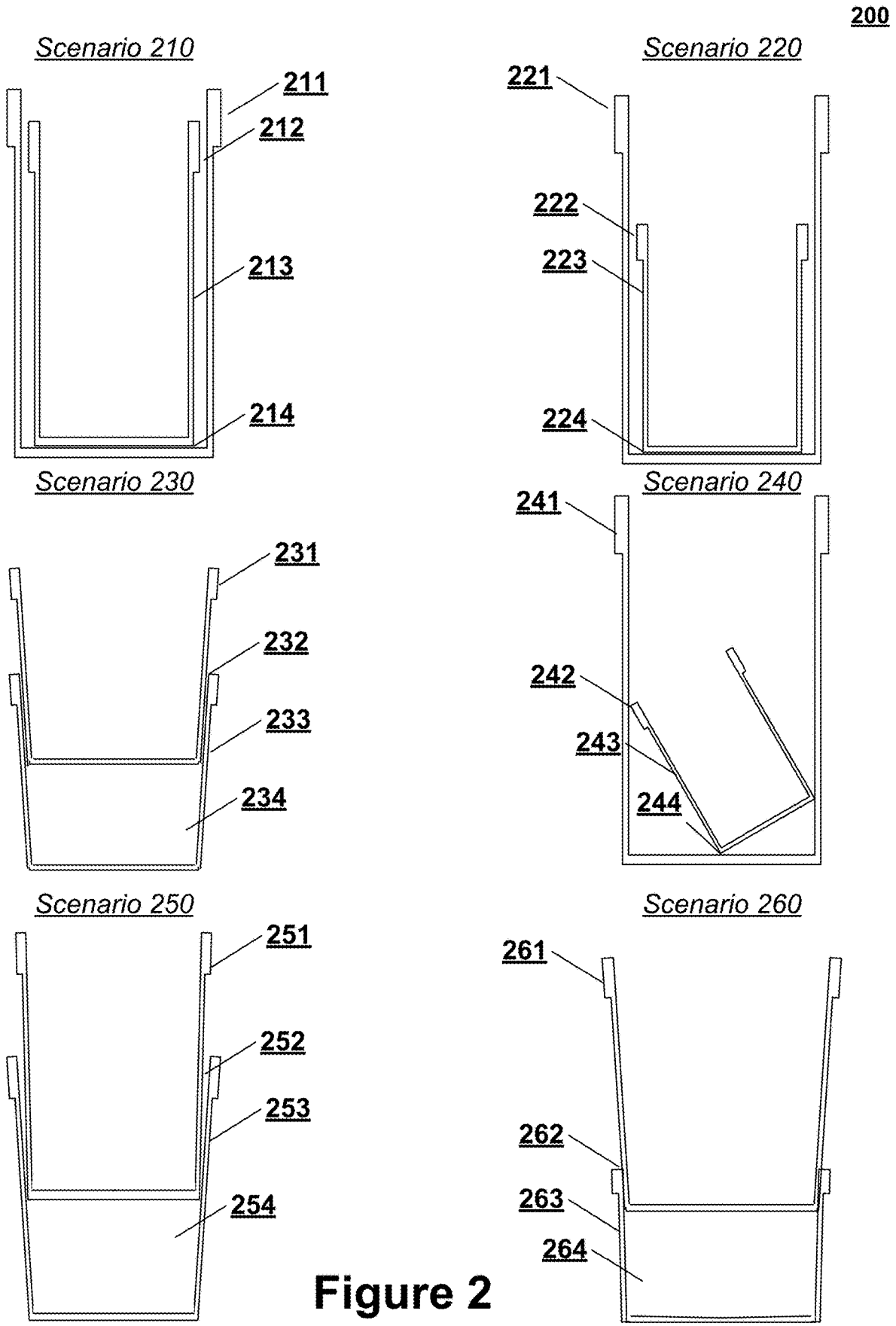
FIG. 2 shows a set of schematic diagrams illustrating a pair of nested containers that may be difficult to separate.

FIG. 2 shows a set 200 of schematic diagrams illustrating a pair of nested containers that may be difficult to separate. Scenario 210 illustrates an inner container 213 nested within an outer container 211. Within vertical surface 212, no contact is present between the vertical container walls to exert any applied force against inner container 213. Within horizontal surface 214, the bottom of inner container 213 rests firmly against the bottom of outer container 211, but this contact is unlikely to exert non-negligible amounts of applied pressure in such a way that lifting inner container 213 is hindered. However, the empty surface in between the lid of inner container 213 and the lid of container 211 is narrow. Combined with the height differential between the pair of containers, separating the containers will likely require a tool or one's hand that is small enough to achieve sufficient grip and dexterity but strong enough to maintain grip and stably balance inner container 213 to separate it from outer container 211. In summary, Scenario 210 illustrates a scenario in which excessive tensional forces are not present, yet the separation of the nested containers may still prove difficult.

Similarly, Scenario 220 illustrates a much-smaller inner container 223 nested within a larger outer container 221. Despite a lack of contact in vertical surface 222 and a lack of problematic force in horizontal surface 224, Scenario 220 nevertheless presents a nested stack that is suboptimal for separation. The greater height differential illustrated in Scenario 220, as compared to Scenario 210, further decreases the capability of a user to maintain grip or leverage sufficient to remove inner container 223.

Scenario 230 illustrates an inner container 231 nested within an outer container 233. Inner container 231 and outer container 233 have near-identical height, diameter, and draft angle. As a result, vertical surface 232 comprises near-full contact along the surfaces of the containers for a large portion of the vertical surface of each respective container. The consistent, tight pressure between the surfaces of inner container 231 and outer container 233 not only contributes frictional force, the reduced air flow through vertical surface 232 may create a partial vacuum in horizontal surface 234, increasing the tensional force necessary to separate inner container 231 from outer container 233.

Scenario 240 is similar to Scenario 210 and Scenario 220 in that inner container 243 is smaller than outer container 241. However, within Scenario 240, force is exerted between the nested contains within both the vertical surface 242 and the horizontal surface 244 because the large size differential between the respective containers allows inner container 243 to nest un-aligned relative to outer container 241. Points of contact are made by three out of the four corners of inner container 243 such that inner container 243 is wedged inside outer container 241, exerting great tensional force between them.

Scenario 250 illustrates an inner container 251 nested within an outer container 253. Inner container 251 has similar dimensions to outer container 253; however, the draft angle of inner container 251 is narrower than the draft angle of outer container 253 and the diameter of inner container 251 is wider than the diameter of outer container 253. Thus, when nested, a point of contact forms on the vertical surface 252. The frictional forces are exerted on a smaller surface area in Scenario 250 than Scenario 230, but the point of contact experiences more pressure. Thus, a partial vacuum is more likely to develop within cavity 254 due to increased pressure from the cavity air onto the walls of the containers.

Scenario 260 illustrates an inner container 261 nested within an outer container 263. Inner container 261 exhibits both a wider draft angle and larger dimensions than outer container 263. When nested, inner container 261 hits a shallow point of contact on the vertical surface 262. The greater mass and draft angle of inner container 261 result in additional force (due to increased magnitude and angular force, respectively) applied on the vertical surface 262, in turn risking additional force exerted by cavity 264 in the form of pressure.

In each described scenario, a variety of geometric factors either result in tight adherence of a respective pair of containers or other routes whereby the inner container can become "stuck", such as falling out of reach inside the outer container. Introduction of a supportive apparatus configured to either introduce a barrier juxtaposed in between respective containers in a nested stack, provide additional support for the center of balance of the inner container in a nested stack, or a combination of both can significantly reduce the likelihood of excessive force being necessary to separate a nested stack of containers.

Container And Cup Separator

Configuration Overview

The disclosed apparatus is a container and cup separator configured to form a partition wedged in between adjacent nested containers, providing applied force against the adjacent surfaces such that the space in between a pair of nested containers is resistant to shrinkage in volume and maintains airflow with the surrounding environment. As a result, the nested containers experience a decrease in mutual friction, easing separation. The disclosed container and cup separator is supported by a connected handle that rests on the outer surface of the outer container, parallel to the partition component of the separator, wherein the vertical components are connected and stabilized by a horizontal component resting on the top surface of the outer container. In many implementations, the separator is supported by a connected handle that rests on the outer surface and the outer container whereby the support is provided by the edge or rim (i.e., the uppermost circumference) of the outer container. Enabled by these structural components, the disclosed container and cup separator is configured to maintain the stability and alignment of the container partition without significantly changing the structural integrity or functionality of a stack of nested containers.

Figure 3:
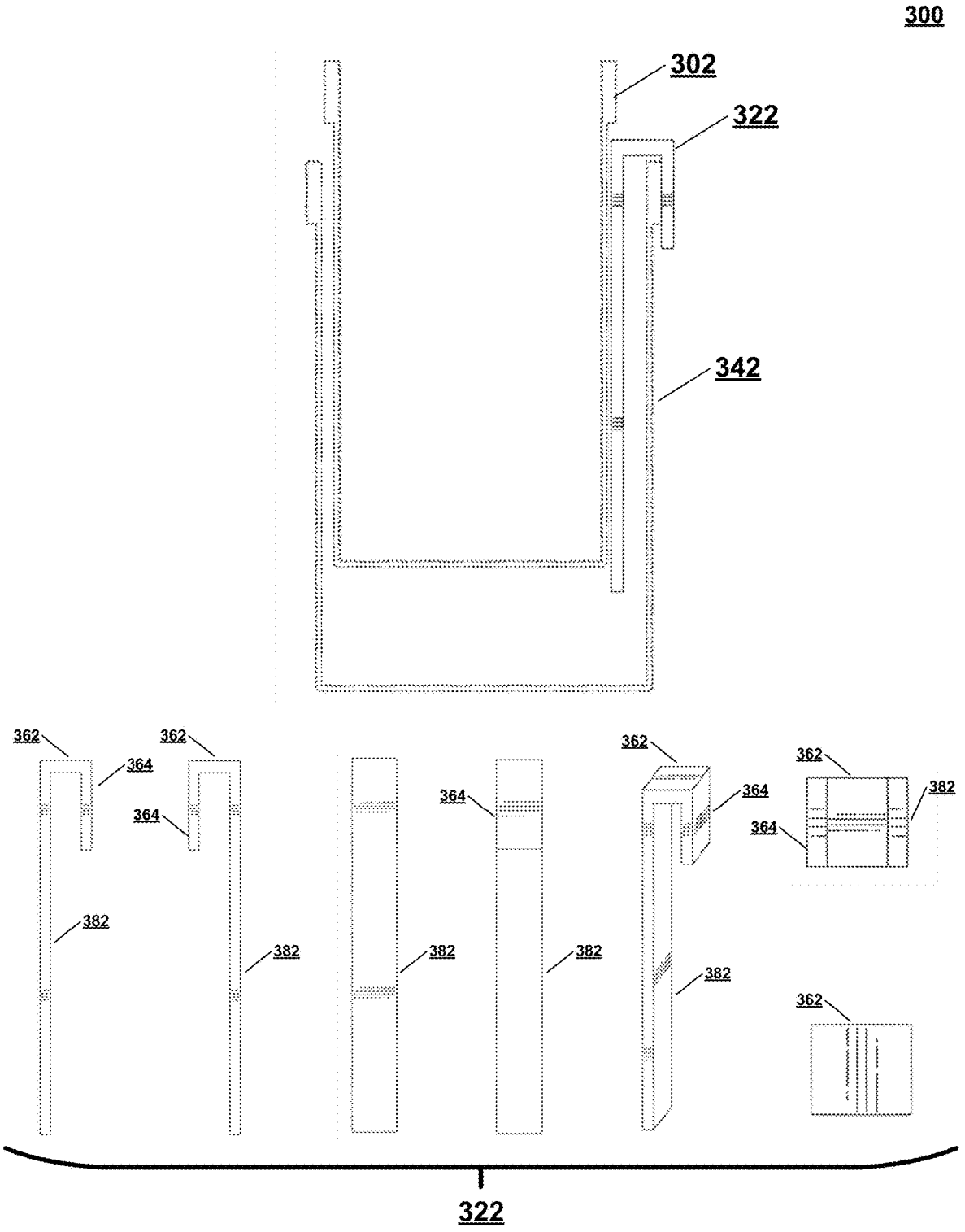
FIG. 3 shows the disclosed apparatus supporting the separation of a pair of nested containers, according to one implementation of the technology disclosed.

FIG. 3 shows the disclosed apparatus supporting the separation of a pair of nested containers, according to one implementation 300 of the technology disclosed. An outer container 342 and inner container 302 are separated by apparatus 322 such that apparatus 322 prevents a seal from forming, as well as additional sources of excessive force. Apparatus 322 is further illustrated from a plurality of angles to emphasize components such as the second upper support member 364 (e.g., a "handle" that is external to the outer container 342 and can be approximately vertical to and/or parallel with a side of the outer container 342). For further example, the second upper support member 364 can extend along a plane that is not transverse to a plane along which the side of the outer container 342 extends. The Apparatus 322 can further include a first upper support member 362 (e.g., a flat support that is configured to receive and be supported by an uppermost surface or rim of the outer container 342 and may be approximately horizontal to a top (rim) of the outer container 342. For further example, the first upper support member 362 can extend along a plane that is transverse to a plane along which the side of the outer container 342 extends. The apparatus 322 can further include partition 382. The partition 382 can include a lower end configured to be located near (or closer to) a bottom portion of an inside portion of the outer container 342 and an upper end configured to be located near (or closer to) a top portion of the inside portion of the outer container 342. In other words, the lower end of the partition 382 can, when installed, be closer to the bottom of the outer container 342 than the top of the outer container 342 and the upper end of the partition 382 can be closer to the top of the outer container 342 than the bottom of the outer container 342.

The first upper support member 362 extends from the upper end of the partition 382 such that, when the apparatus 322 is installed, the first upper support member 362 is supported by a top rim of outer container 342. Second upper support member 364 allows for accessible manipulation of apparatus 322, supported and balanced by first upper support member 362. First upper support member 362 is supported by the rim, or uppermost edge, of outer container 342, providing a lateral and/or balanced base for apparatus 322 to rest on. Partition 382 forms a barrier between inner container 302 and outer container 342, lessening (modifying) the area of contact within the nested stack (e.g., restricting one or more size dimensions of the area and/or location of contact). The upper end of the partition 382 and the first upper support member 362 form an angle between 80 and 100 degrees, inclusive. The upper end of the partition 382 and the first support member can form an L-shaped structure, such that the first upper support member is a shorter portion of the L-shaped structure, and the partition is a longer portion of the L-shaped structure.

The second upper support member 364 extends from the first upper support member 362 such that the upper end of the partition 382, the first upper support member 362, and the second upper support member 364 form a U-shaped structure such that, when the apparatus 322 is installed, the top rim of the outer container 342 is located in a first support area formed by the upper end of the partition 382, the first upper support member 362, and the second upper support member 364.

The first upper support member and the second upper support member form an angle between 80 and 100 degrees, inclusive, such that the second upper support member and the partition can extend along non-transverse planes and the first upper support member can extend along a plane that is transverse to the planes upon which the second upper support member and the partition extend.

Further Configurations

In some implementations, the disclosed container and cup separator further comprises a lower support member configured to support the bottom surface of an inner nested container. The lower support member is configured to provide additional support for the inner container, which may prevent at least one of the following: preventing the inner container from dropping to a further depth within the outer container or resting at an off-center angle, risking the creation of tension between the inner bucket and the outer bucket, and/or the inner bucket and the separator itself.

Figure 4:
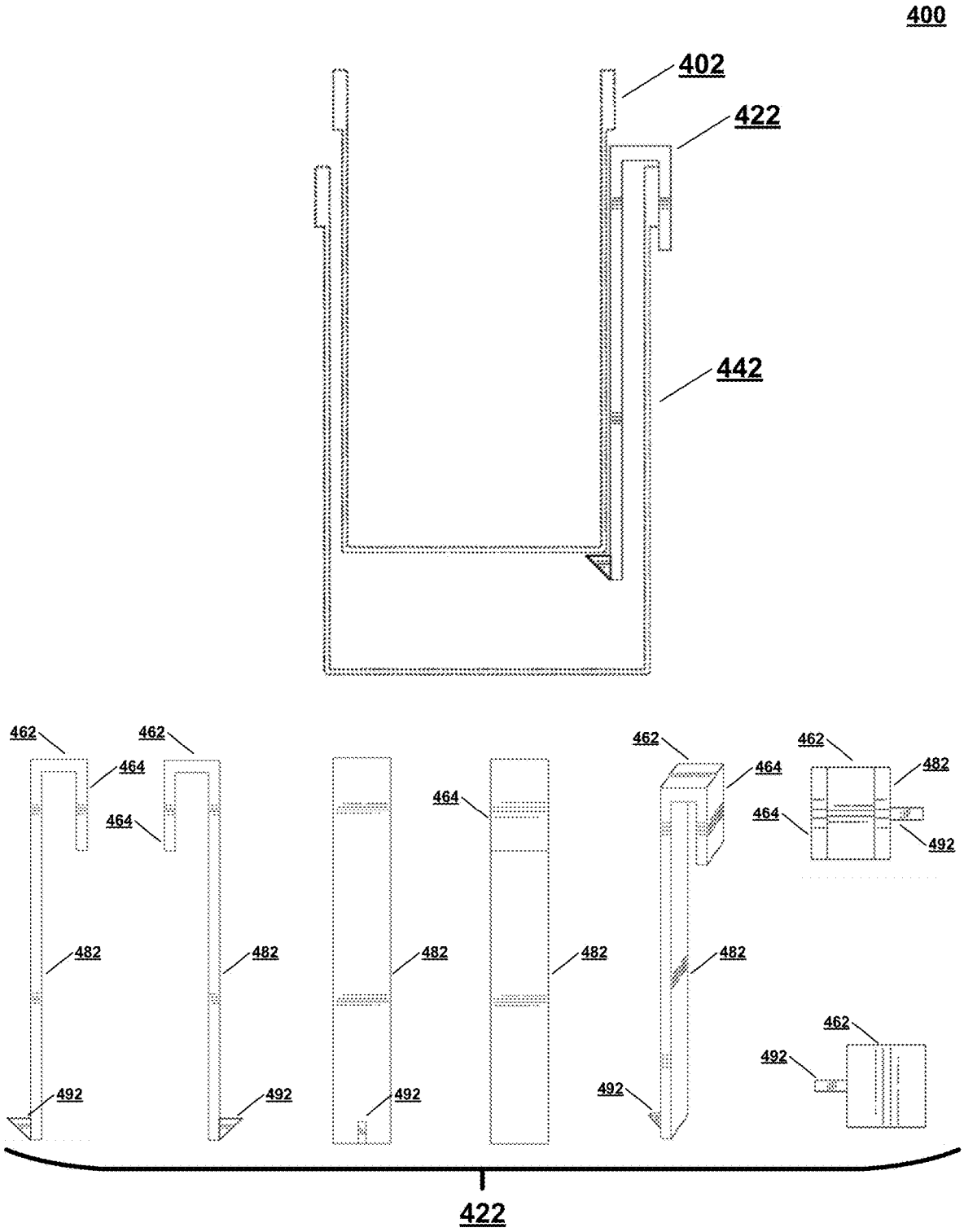
FIG. 4 shows the disclosed apparatus further comprising a lower support member, according to one implementation of the technology disclosed.

FIG. 4 shows the disclosed apparatus further comprising a lower support member, according to one implementation 400 of the technology disclosed. An outer container 442 and inner container 402 are separated by apparatus 422 such that apparatus 422 prevents a seal from forming, as well as preventing additional sources of excessive force such as angular force applied as a result of inner container 402 settling in misalignment with outer container 442. Apparatus 422 is further illustrated from a plurality of angles to emphasize components such as the second upper support member 464, first upper support member 462, partition 482, and triangular lower support member 492. Second upper support member 464 allows for accessible manipulation of apparatus 422, supported and balanced by first upper support member 462. This configuration, including the second upper support member 464 extending from the first upper support member 462, is configured such that the upper end of the partition 482. Partition 482 forms a barrier between inner container 402 and outer container 442, lessening the area of contact within the nested stack. Apparatus 422 further comprises triangular lower support member 492, which can provide additional support for inner container 402 such that inner container 402 remains both supported and balanced. Triangular lower support member 492 may, for example, further prevent inner container 402 from falling in too deep within outer container 442, becoming difficult to reach in addition to maintaining balance within the nested stack. Generally, lower support member 492 extends from the lower end of the partition 482 such that, when apparatus 422 is installed, the lower support member 492 receives a bottom portion of the inner container 402 to prevent further insertion of the bottom portion of the inner container. As illustrated in FIG. 4, a length of the lower support member 492 can be less than one or more of: a length of the second upper support member 464, a length of the first upper support member 462, and/or a length of the partition 482.

Various implementations comprise different configurations of the lower support member introduced in implementation 400. The lower support member may comprise a plurality of alternative configurations; however, two representative example configurations, 400 and 500, are described herein. These configurations are not to be considered limitations of the disclosed apparatus and it is to be understood that a plurality of configurations for the lower support member may be adapted to support a plurality of container styles without diverting from the spirit or the scope of the disclosed apparatus. Nested containers may comprise a plurality of geometries (e.g., draft angle, wall width, or circumference), mass (e.g., a heavier material requiring a larger platform for adequate support), nesting configurations (e.g., intended depth of insertion of the inner container into the outer container, the presence or lack thereof one or more indentations or protrusions to support stacking, or further interlocking components) and centers of mass (e.g., a container with skewed weight distribution). Hence, the disclosed lower support member component may comprise one of a plurality of widths, anterior and posterior angles as determined by the depth angle of either the inner or outer container, respectively, superior and inferior surface topologies, or a number of subcomponents to sufficiently accommodate a particular container design.

Figure 5:
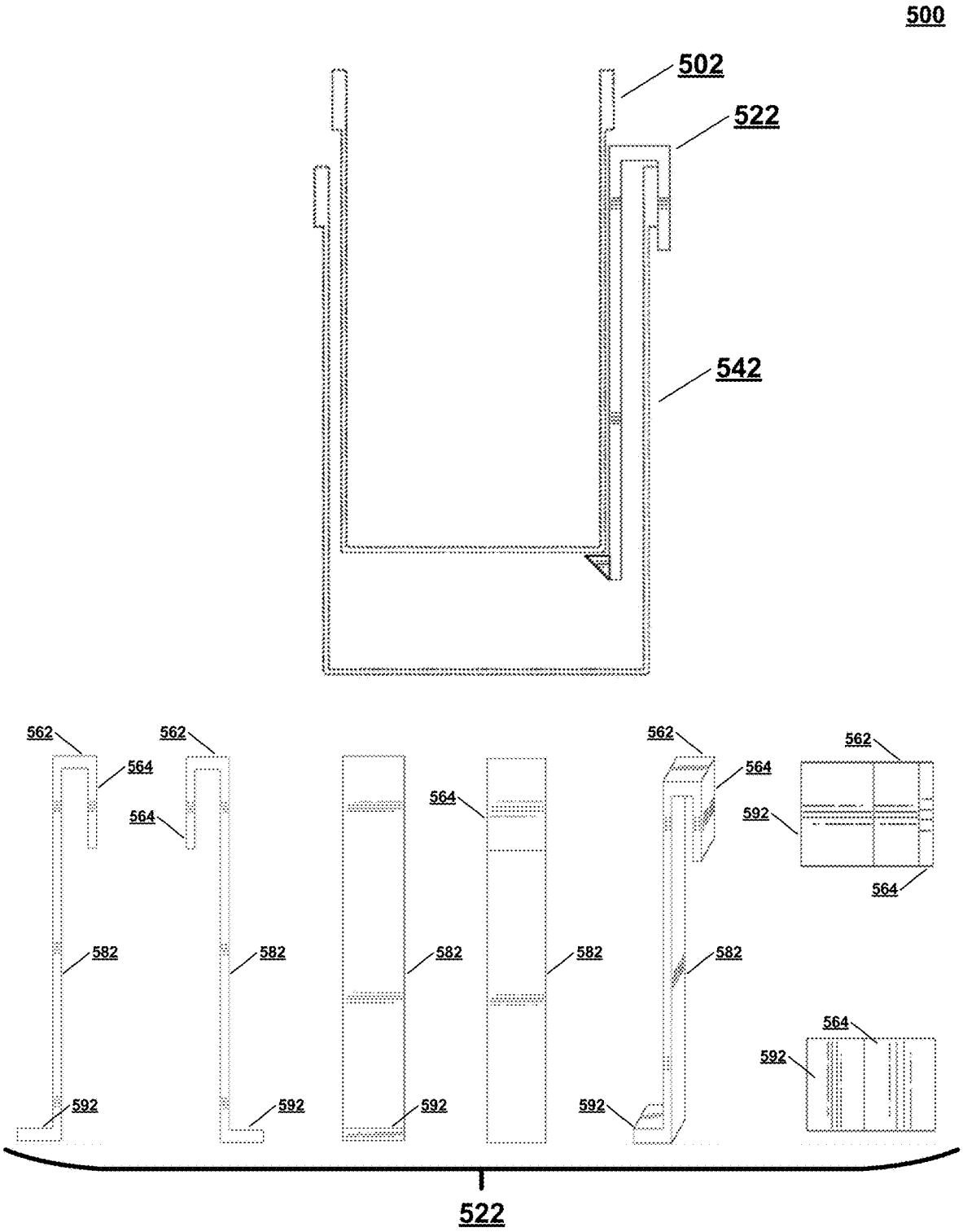
FIG. 5 shows the disclosed apparatus further comprising an alternative configuration for the lower support member, according to one implementation of the technology disclosed.

FIG. 5 shows the disclosed apparatus further comprising an alternative configuration for the lower support member, according to one implementation of the technology disclosed. An outer container 542 and inner container 502 are separated by apparatus 522 such that apparatus 522 prevents a seal from forming, as well as preventing additional sources of excessive force such as angular force applied as a result of inner container 502 settling in misalignment with outer container 542. Apparatus 522 is further illustrated from a plurality of angles to emphasize components such as the second upper support member 565, first upper support member 562, partition 582, and rectangular lower support member 592. Second upper support member 565 allows for accessible manipulation of apparatus 522, supported and balanced by first upper support member 562. Partition 582 forms a barrier between inner container 502 and outer container 542, lessening the area of contact within the nested stack. Apparatus 522 further comprises rectangular lower support member 592, providing additional support for inner container 502 such that inner container 502 remains both supported and balanced. Rectangular lower support member 592 may, for example, further prevent inner container 502 from falling in too deep within outer container 542 where it is difficult to reach in addition to maintaining balance within the nested stack. The alternative geometry of rectangular lower support member 592 as compared to triangular lower support member 492 has less lateral stability and takes up more horizontal space, but offers a greater moment of inertia and section modulus for the cross-sectional area. The triangular lower support member 492 has greater shear strength, however, due to the internal force holding the triangle together. Hence, the rectangular lower support member 592 and triangular lower support member 492 have different sets of advantages and disadvantages for a given use case. In most implementations, independent of the geometrical category of the lower support member (e.g., triangular, rectangular, etc.), the lower end of the partition and the lower support member form an angle between 80 and 100 degrees, inclusive. As illustrated in FIG. 5, a length of the lower support member 592 can be less than one or more of: a length of the second upper support member 564, a length of the first upper support member 562, and/or a length of the partition 582.

As an example, consider a nested stack of containers wherein at least one inner container has either a diameter or mass greater than the maximum capacity reliably supported by triangular lower support member 492. Alternatively, consider a nested stack of containers wherein at least one inner container has a non-flat base (e.g., slanted base or additional protrusions extending from the base such that the center of balance is not located at the direct center of the container) wherein the thin, angled structure of triangular lower support member 492 is not sufficiently capable of balancing the inner container. Use cases including, but not limited to, these described scenarios may benefit from the configuration described within implementation 500. However, smaller or lighter containers, particularly those comprising steep draft angles, may not fit with the bulkier rectangular lower support member 592, and thus would be better suited for implementation 400. In certain implementations, the rigidity of lower support members 492 or 592 provides a limitation rather than a benefit due to the lack of flexibility in versatile situations.

In these implementations, the disclosed apparatus is further configured to comprise one or more adjustable supports, such as via holes. Of note, the stability and benefit of the lower support member are heavily influenced by the type of material used to construct the platform. Varying materials comprise various structural properties that will influence the manner in which a platform behaves. Moreover, certain structural properties of a particular material composition are further influenced by its geometry as well (i.e., a first particular material may have significantly lower shear resistance in an identical geometrical configuration to a second particular material). Thus, any discussion herein comparing the shape of alternative lower support member configurations omits composition-dependent factors for simplicity of description.

In other implementations, the disclosed container and cup separator further comprises one or more via holes configured to receive a peg apparatus, such as a nail, as an alternative method of providing support to the bottom surface of the inner container. The peg apparatus inserted is limited in diameter to fit within the via hole; however, the length of the peg apparatus is limited by the outer bucket diameter itself. The peg, when the peg and the apparatus are installed, may form a lower support member that receives a bottom portion of an inner container to prevent further insertion of the bottom portion of the inner container. The peg lower support member may be a substitution for the above-described implementations of the platform lower support member, or may be an additional lower support member in combination with the platform lower support member in other implementations. For an example use case, consider nesting an inner container with a smaller diameter than the outer container, such that the inner container is too small to rest on the outer container (or the partition component of the separator) while properly balanced and aligned to receive an even distribution of support from the nesting arrangement. By inserting a peg apparatus into a via hole of the separator with sufficient length to support the inner container such that: (i) the inner container is unlikely or unable to fall to the bottom of the outer container and (ii) the inner container is unlikely or unable to nest at an incongruent angle resulting in excessive force being applied at specific, limited points of contact. Support by a peg apparatus inserted into a via hole, therefore, increases the stability of the nested containers, as well as decreases the potential for excessive force to be exerted upon the containers, making the containers difficult to separate.

Figure 6:
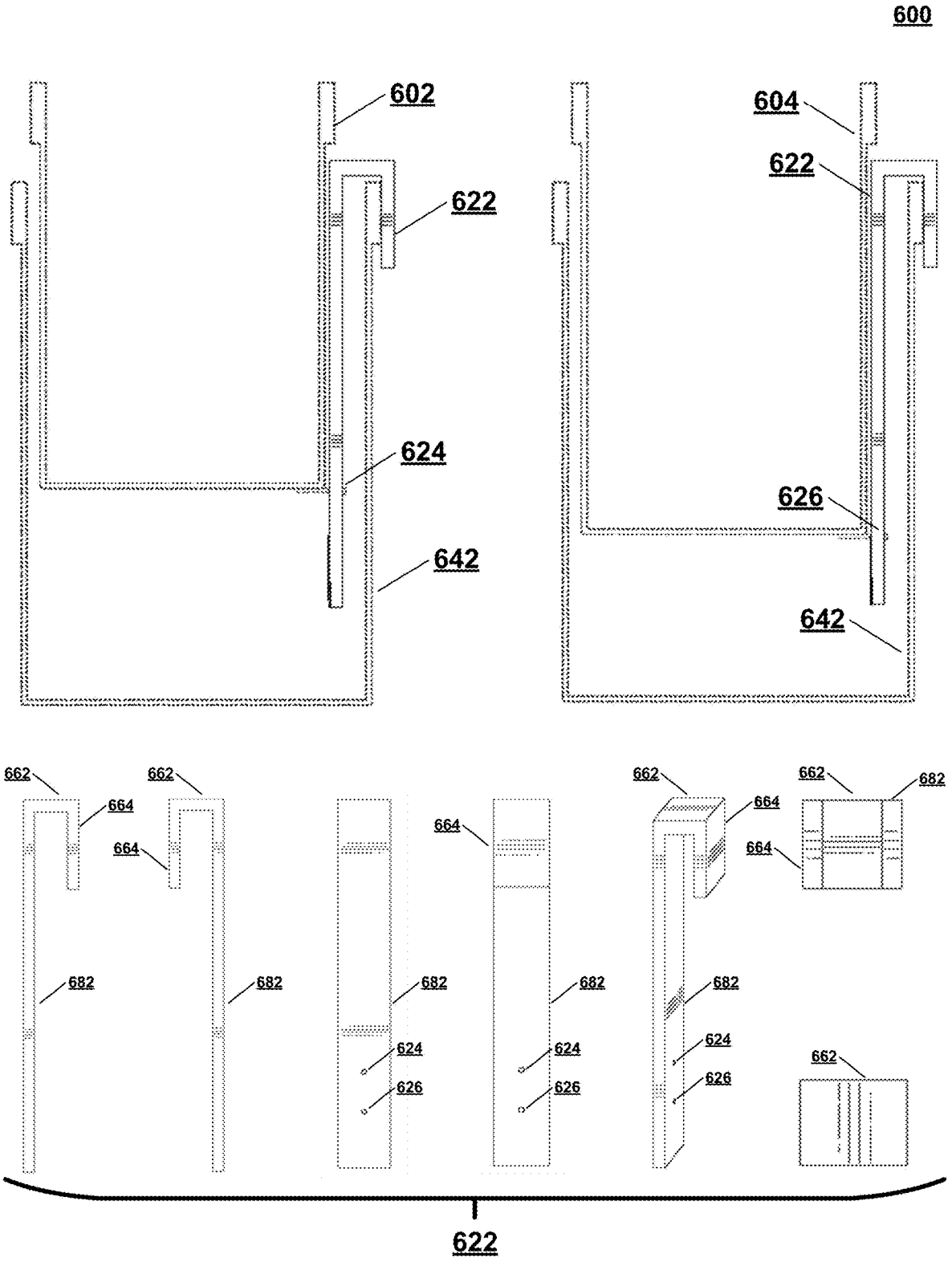
FIG. 6 shows the disclosed apparatus further comprising a set of via holes, according to one implementation of the technology disclosed.

Certain implementations further comprise a series of two or more via holes at varying heights, increasing the compatibility of the separator at a larger range of height differentials between inner and outer containers. FIG. 6 shows the disclosed apparatus further comprising a set of via holes, according to one implementation 600 of the technology disclosed.

An outer container 642 and a first inner container 602 are separated by apparatus 622 such that apparatus 622 prevents a seal from forming, as well as preventing additional sources of excessive force such as angular force applied as a result of inner container 602 settling in misalignment with outer container 642. A lower support member is formed by a peg (e.g., a nail, dowel, pin, et cetera) inserted into upper via hole 624, controlling the nesting depth. In comparison, outer container 642 is also shown with a second inner container 604, where outer container 642 and inner container 604 are separated by apparatus 622 with a peg inserted into lower via hole 626, allowing inner container 604 to settle deeper than upper via hole 624 allows inner container 602 to settle.

Apparatus 622 is further illustrated from a plurality of angles to emphasize components such as the second upper support member 664, first upper support member 662, partition 682, upper via hole 624, and lower via hole 626. Second upper support member 664 allows for accessible manipulation of apparatus 622, supported and balanced by first upper support member 662. Partition 682 forms a barrier between inner container 602 and outer container 642, lessening the area of contact within the nested stack. Apparatus 622 further comprises both upper via hole 624 and lower via hole 626, providing additional support for an inner container, such that the inner container remains both supported and balanced. In contrast to implementations 400 and 500 comprising a lower support member formed by a platform-like lower support member that extends from the partition, implementation 600 comprises a wider range of depth control using upper via hole 624 and lower via hole 626. Whereas various implementations of the disclosed apparatus comprising a lower support member with no via holes are restricted to only supporting an inner container at a single height, pre-determined once manufactured, other implementations of the disclosed apparatus comprising a via hole can be more versatile in certain use cases. If a particular set of nested containers cannot accommodate any protruding elements without disrupting the fit and stability of the nested stack, the via hole can be left empty, effectively functioning similarly to implementation 300. However, if there is both reasonable space and a warranted need for additional support for an inner container, a peg may be inserted.

The length of the peg is only constrained by the diameter of the containers to be nested; thus, the extent of support is also tractable. Moreover, the disclosed apparatus may be configured to comprise any number of via holes to accommodate a plurality of inner container dimensions.

Yet other implementations further comprise both a lower support member and a set of one or more via holes, such that the separator is compatible with a range of height differentials between inner and outer containers at a wider possible range of height differentials for the particular size dimensions respective to a particular separator implementation. Accordingly, an implementation comprising both a lower support member and a set of one or more via holes benefits both from the rigidity of the lower support member and the flexibility of the set of via holes.

Figure 7:
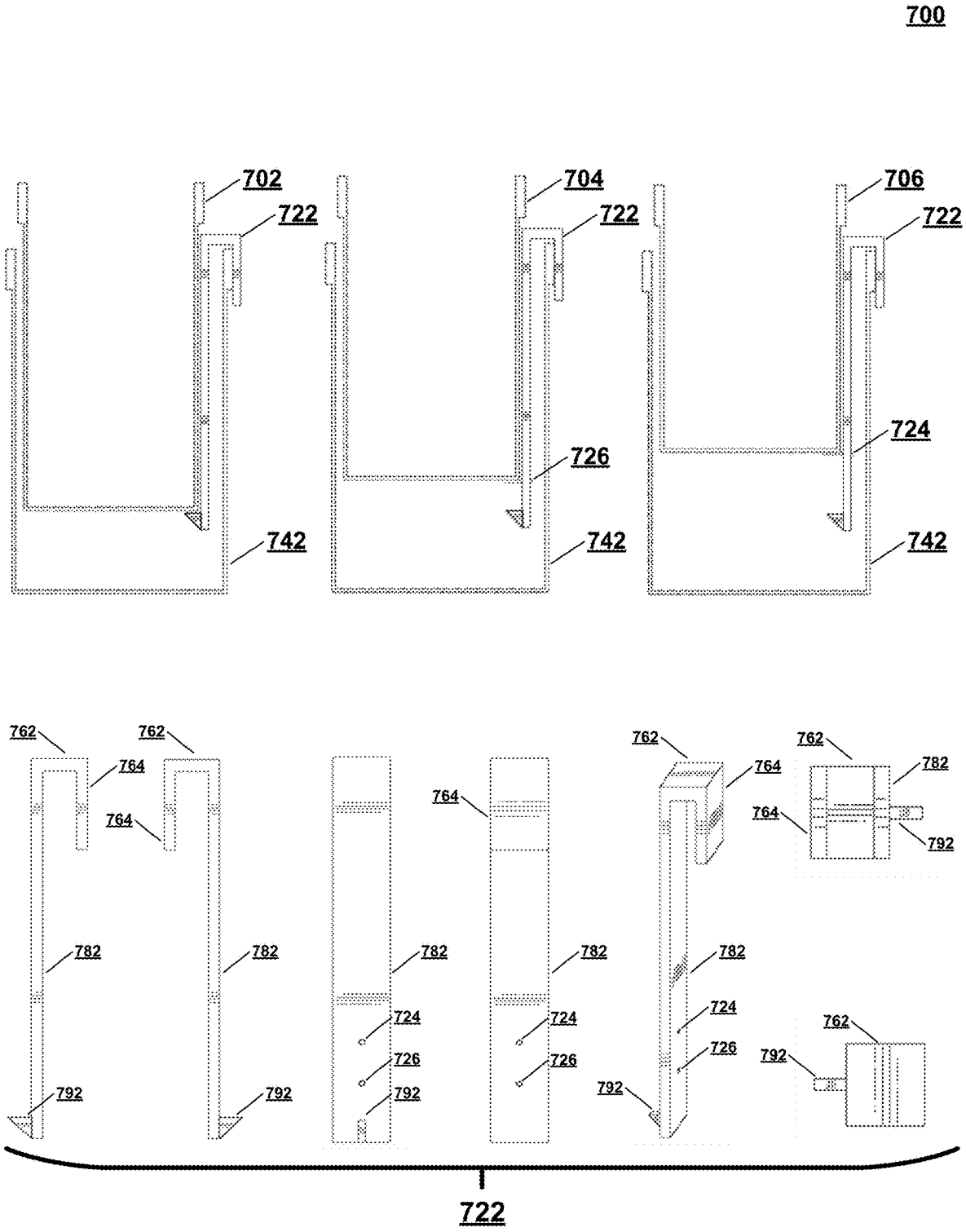
FIG. 7 shows the disclosed apparatus further comprising a lower support member and a set of via holes, according to one implementation of the technology disclosed.

FIG. 7 shows the disclosed apparatus further comprising a lower support member and a set of via holes, according to one implementation of the technology disclosed. An outer container 742 and first inner container 702 are separated by apparatus 722 such that apparatus 722 prevents a seal from forming, as well as preventing additional sources of excessive force such as angular force applied as a result of the first inner container 702 settling in misalignment with outer container 742. Support is provided by a lower support member 792. In one implementation of the disclosed apparatus, lower support member 792 can be a triangular support. In other implementations of the disclosed apparatus, lower support member 792 can be a rectangular support. In yet other implementations, lower support member 792 can be a plurality of other structural support configurations, wherein lower support member 792 is any component of apparatus 722 that increases stability and separability of an inner container by means of supporting the base of the inner container.

In comparison, outer container 742 is also shown with a second inner container 704, where the outer container 742 and the second inner container 704 are separated by apparatus 722 with a peg, forming a lower support member, inserted into lower via hole 726. Support is provided by a peg (e.g., a nail, dowel, pin, et cetera) inserted into lower via hole 726, controlling the nesting depth. Finally, outer container 742 is also shown with a third inner container 706, where outer container 742 and the third inner container 706 are separated by apparatus 722 with a peg inserted into upper via hole 724, limiting the third inner container 706 to a shallower depth than upper via hole 724 allows for inner container 702.

Apparatus 722 is further illustrated from a plurality of angles to emphasize components such as the second upper support member 764, first upper support member 762, partition 782, lower support member 792, upper via hole 724, and lower via hole 726. Second upper support member 764 allows for accessible manipulation of apparatus 722, supported and balanced by first upper support member 762. Partition 782 forms a barrier between inner container 702 and outer container 742, lessening the area of contact within the nested stack. Apparatus 722 further comprises lower support member 792, upper via hole 724 and lower via hole 726, providing additional support for an inner container, such that the inner container remains both supported and balanced. In contrast to implementations 400, 500, or 600, implementation 700 comprises the largest range of depth control using lower support member 792, upper via hole 724 or lower via hole 726 configured to support a number of use cases with differing material, mass, height differentials, diameter differentials, depth angle differentials, center of balance, or many other properties of nested containers influencing stability and separability.

Thus far, the discussion has covered a plurality of particular implementations for the disclosed container and cup separator comprising alternative components arranged within a similarly designed separator. However, the angle and width of the representative apparatuses may not meet the particular demands of any nested stack of containers. Certain configuration differences may extend beyond the shape or size of a particular component to a comprehensive feature influencing the shape or size of the entire apparatus.

A plurality of previously described features that influence the functioning of a container and cup separator will now again be summarized. A large number of container-shaped objects that are configured to be stored or transported in a nested stack exist. These containers comprise a plurality of nonoverlapping features such as shape, size, weight, and presence or lack thereof various components such as a lid, handle, or specific surface topologies. Properties related to the stability of a container and cup separator, such as shear strength, elasticity, and load-bearing capacity, are further influenced by the properties of the material with which the separator is fabricated. As a result, any metrics computed for the performance of a particular implementation will be strongly influenced by the specific combination of features describing each respective container within a stack, the function of the stack, the environment with which the stack is placed, and the apparatus itself. Given the number of features individualizing each potential real world scenario, the disclosed apparatus may be implemented in a variety of geometries beyond the linear, right-angled structure disclosed in the above implementations. An example is now given within implementation 800.

Figure 8:
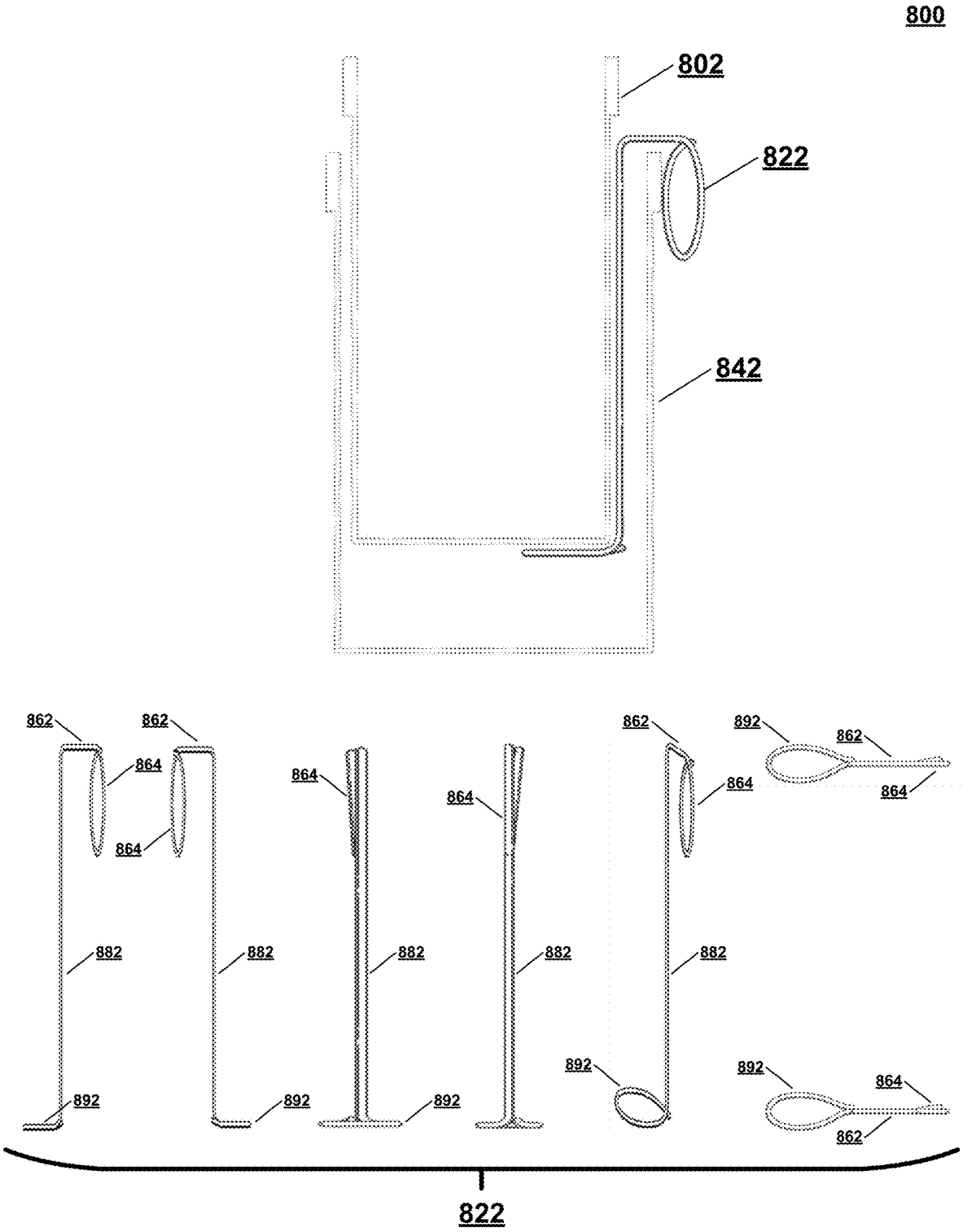
FIG. 8 shows a wire configuration of the disclosed apparatus, according to one implementation of the technology disclosed.

FIG. 8 shows a wire configuration of the disclosed apparatus, according to one implementation 800 of the technology disclosed. Whereas previous implementations comprise sheets of material connected by right angles, disclosed apparatus 822 separating inner container 802 and outer container 842 has a wire structure, further comprising rounded edges and looped ends. An outer container 842 and inner container 802 are separated by apparatus 822 such that apparatus 822 prevents a seal from forming, as well as preventing additional sources of excessive force such as angular force applied as a result of inner container 802 settling in misalignment with outer container 842. Apparatus 822 is further illustrated from a plurality of angles to emphasize components such as the second upper support member 864, first upper support member 862, partition 882, and circular lower support member 892. Second upper support member 864 allows for accessible manipulation of apparatus 822, supported and balanced by first upper support member 862. Partition 882 forms a barrier between inner container 802 and outer container 842, lessening the area of contact within the nested stack. Apparatus 822 further comprises circular lower support member 892, providing additional support for inner container 802 such that inner container 802 remains both supported and balanced. Circular lower support member 892 further prevents inner container 802 from falling in too deep within outer container 842, becoming difficult to reach in addition to maintaining balance within the nested stack.

A variety of benefits are associated with the use of a wire structure over a sheet structure in certain implementations. For example, most materials will have greater elasticity in wire form than in sheet form. In a first scenario where flexibility is prioritized over strength, such as stacking nestable containers that are particularly prone to forming high-friction contact with other surfaces, it is ideal for the separator to be more elastic to limit adhesion between the surface of a container and the surface of the separator. Wire structure separators with higher elasticity than their material-controlled, sheet structure counterparts are also less prone to rupture under strain or force while bearing weight. However, in a second scenario wherein the containers within a nested stack have a significantly large size or mass, a wire structure separator may not be strong enough to provide a sufficient partition between the nested containers to adequately contribute to the ease of separation. Consequently, within the second scenario, a sheet structure may be preferable to a material-controlled wire structure counterpart. The comparison of sheet and wire format is given explicitly as an example, and a user skilled in the art will recognize that a particular material or combination of materials can be fashioned into many additional shapes configured to form a partition in between nested containers within a stack while remaining within the bounds and scope of the disclosed technology.

Some or all of the above-described implementations can relate to a method of installing an apparatus that separates an inner container and an outer container, the apparatus including a partition comprising (i) a lower end configured to be located near a bottom portion of an inside portion of the outer container and (ii) an upper end configured to be located near a top portion of the inside portion of the outer container, and including a first upper support member extending from the upper end of the partition, a second upper support member extending from the first upper support member, such that the upper end of the partition, the first upper support member and the second upper support member form a U-shaped structure and a lower support member extending from the lower end of the partition. The method can further comprise installing the apparatus by placing a first support area formed by the U-shaped structure on an upper rim of the outer container, such that at least a portion of the partition and the lower support member are located inside the outer container and such that the first upper support member is in contact with and supported by the upper rim of the outer container and placing the inner container within the outer container, such that an outer wall of the inner container is in contact with the partition which forms an air gap between an inner wall of the outer container and the outer wall of the inner container and such that a bottom portion of the inner container is in contact with and supported by the lower support member.

In some implementations, the method can further comprise installing a second apparatus including a partition comprising (i) a lower end configured to be located near a bottom portion of an inside portion of the outer container and (ii) an upper end configured to be located near a top portion of the inside portion of the outer container, and including a first upper support member extending from the upper end of the partition, a second upper support member extending from the first upper support member, such that the upper end of the partition, the first upper support member and the second upper support member form a U-shaped structure and a lower support member extending from the lower end of the partition. The second apparatus can be installed prior to the placing of the inner container within the outer container. The second apparatus can be installed by placing a first support area of the second apparatus formed by the U-shaped structure of the second apparatus on an upper rim of the outer container, such that at least a portion of the partition of the second apparatus and the lower support member of the second apparatus are located inside the outer container and such that the first upper support member of the second apparatus is in contact with and supported by the upper rim of the outer container. The second apparatus may provide additional support for the inner container, which may be useful for certain use cases in which the inner container weighs enough that one apparatus does not provide sufficient support.

Particular Implementations

Some particular implementations and features for a container and cup separator configured to form a partition in between adjacent nested containers are now discussed in further detail.

In many implementations of the disclosed apparatus, the partition is configured to modify the area of contact formed between the surfaces of nested containers within a stack. In one implementation, the partition restricts the area or size of the contact formed between the container surfaces. In another implementation, the partition adjusts the locations where contact is formed between the container surfaces. In yet another implementation, the force exerted onto the area of contact is modified via reduction of magnitude or alteration of the interaction between a force and a container surface (e.g., absorption, adsorption, or distribution of force).

In certain implementations, the disclosed apparatus is configured to be inserted into the outer container before the inner container is inserted into the outer container as a preventative measure to reduce a potential force necessary for separation before the nested stack is constructed. In other implementations, the disclosed apparatus is configured to be inserted in between the outer container and the inner container within a previously nested stack as a fixative measure to reduce a realized force necessary for separation after the nested stack is constructed. As an example, the disclosed apparatus may be tapered such that the narrowest end of the apparatus can be inserted in between a pair of nested containers and create distance between the nested containers as the apparatus is further inserted.

Some implementations of the disclosed apparatus further comprise one or more external components configured to mediate handling of the apparatus or to act as a counterbalance for the partition, such as second upper support member 364, 464, 564, 664, 764, or 864. A plurality of external components may be present in certain implementations. In some implementations, one or more external components are configured to have a degree of elasticity such that an external component can be temporarily manipulated into an altered shape or position.

The external components present in certain implementations may be configured to mediate handling of the disclosed apparatus, provide further structural support to the nested stack, or act as a counterbalance to internal components of the disclosed apparatus.

In other implementations, the disclosed apparatus further comprises one or more connection components to attach one or more external components to the partition, such as components 362, 462, 562, 662, 762, and 862.

Many implementations of the disclosed technology further comprise one or more components configured to provide further support for the inner container in addition to any support provided by the partition. In some implementations, these additional supporting components are attached to the partition. In some implementations, these additional supporting components are configured to provide support to the inner container via contact with the bottom of the inner container. In one implementation, the additional supporting component is a lower support member. Various implementations of the disclosed lower support member comprise a range of structural geometries, such as triangular, rectangular, or circular. The lower support member may be placed at differing heights on the partition, which may comprise a variety of heights as well. In certain implementations, the disclosed apparatus comprises more than one lower support member at various heights.

In another implementation, the additional supporting component is a set of one or more via holes configured to hold an insertable and removable peg that forms a peg-based lower support member. Many implementations of the disclosed apparatus contain a plurality of via holes, with or without the addition of a platform-based lower support member.

The disclosed apparatus may be implemented in accordance with a plurality of particular structural designs, such as sheet or wire structure. A particular structural design can be described by features such as material composition (e.g., metal versus plastic), angle and curvature of a vertex (e.g., right-angle corners versus curved edges), or tensile strength factors (e.g., elasticity, resistance, or weight loading capacity).

While the implementations described herein are presented as distinct apparatuses with distinct blocks in particular configurations, a variety of further combinations and permutations are possible within the scope and spirit of the described technology. Many analogous components exist across the described implementations (e.g., implementation 400 and implementation 800 have analogous components 492 and 892) which can be readily introduced to alternative configurations.

Furthermore, components described in a singular context can also be implemented as a plurality. For example, the disclosed separator may comprise two attached partitions connected by a shared lower support member. In one implementation, two or more separator apparatuses may be used simultaneously to provide added support for the inner container. If the inner container is heavier, e.g., dense or filled with a substance, multiple separators can be distributed in various positions around the uppermost circumference of the outer container to distribute the weight of the inner container across the multiple separators (e.g., a container separation system that includes multiple separators or apparatuses for each container). Moreover, the stack may contain a higher number of nested containers, introducing progressively more pressure onto the outermost buckets at the bottom of the stack. In addition to placing separator apparatuses between each respective layer of nested buckets, varying numbers of separator apparatuses may be used for each respective layer of nested buckets to prevent the risk of excessive force being applied onto a container significantly increasing in relation to how many nested objects are stacked within the container.

In certain implementations of the disclosed apparatus, the partition includes a lower end configured to be located near a bottom portion of an inside portion of the outer container and an upper end configured to be located near a top portion of the inside portion of the outer container. The apparatus can further include a first upper support member extending from the upper end of the partition, such that, when the apparatus is installed, the first upper support member is supported by a top rim of the outer container. In one implementation, the upper end of the partition and the first upper support member form an L-shaped structure, such that the first upper support member is a shorter portion of the L-shaped structure, and the partition is a longer portion of the L-shaped structure. In another implementation, the upper end of the partition and the upper support member form an angle between 80 and 100 degrees, inclusive.

The disclosed apparatus may further include a second upper support member extending from the first upper support ember, such that the upper end of the partition, the first upper support member and the second upper support member form a U-shaped structure and such that, when the apparatus is installed, the top rim of the outer container is located in a first support area formed by the upper end of the partition, the first upper support member and the second upper support member. The first upper support member and the second upper support member can form an angle between 80 and 100 degrees, inclusive, such that the second upper support member and the partition can extend along non-transverse planes and the first upper support member can extend along a plane that is transverse to the planes upon which the second upper support member and the partition extend, in accordance with one implementation of the technology disclosed.

The disclosed apparatus, in some implementation, further comprises a lower support member extending from the lower end of the partition, such that, when the apparatus is installed, the lower support member receives a bottom portion of the inner container to prevent further insertion of the bottom portion of the inner container. In one implementation, the apparatus includes a lower support member extending from the lower end of the partition, such that, when the apparatus is installed, the lower support member receives a bottom portion of the inner container to prevent further insertion of the bottom portion of the inner container. The lower end of the partition and the lower support member can form an angle between 80 and 100 degrees, inclusive.

The apparatus can further include one or more via holes located in the partition, wherein the one or more via holes are configured to receive a peg that forms a lower support member, such that, when the peg and the apparatus are installed, the lower support member receives a bottom portion of the inner container to prevent further insertion of the bottom portion of the inner container, in many disclosed implementations.

The technology disclosed also relates to a method of installing an apparatus that separates an inner container and an outer container, the apparatus including a partition comprising (i) a lower end configured to be located near a bottom portion of an inside portion of the outer container and (ii) an upper end configured to be located near a top portion of the inside portion of the outer container, and including a first upper support member extending from the upper end of the partition, a second upper support member extending from the first upper support member, such that the upper end of the partition, the first upper support member and the second upper support member form a U-shaped structure and a lower support member extending from the lower end of the partition. The method further includes installing the apparatus by placing a first support area formed by the U-shaped structure on an upper rim of the outer container, such that at least a portion of the partition and the lower support member are located inside the outer container and such that the first upper support member is in contact with and supported by the upper rim of the outer container, and placing the inner container within the outer container, such that an outer wall of the inner container is in contact with the partition which forms an air gap between an inner wall of the outer container and the outer wall of the inner container and such that a bottom portion of the inner container is in contact with and supported by the lower support member.

Some implementations of the method further involve installing a second apparatus including a partition comprising (i) a lower end configured to be located near a bottom portion of an inside portion of the outer container and (ii) an upper end configured to be located near a top portion of the inside portion of the outer container, and including a first upper support member extending from the upper end of the partition, a second upper support member extending from the first upper support member, such that the upper end of the partition, the first upper support member and the second upper support member form a U-shaped structure and a lower support member extending from the lower end of the partition. The second apparatus can be installed prior to the placing of the inner container within the outer container and, by placing a first support area of the second apparatus formed by the U-shaped structure of the second apparatus on an upper rim of the outer container, such that at least a portion of the partition of the second apparatus and the lower support member of the second apparatus are located inside the outer container and such that the first upper support member of the second apparatus is in contact with and supported by the upper rim of the outer container.

The apparatus described in this section and other sections of the technology disclosed can include one or more of the following features and/or features described in connection with additional apparatus disclosed. In the interest of conciseness, the combinations of features disclosed in this application are not individually enumerated and are not repeated with each base set of features. The reader will understand how features identified in this apparatus can readily be combined with sets of base features identified as implementations.

The preceding description is presented to enable the making and use of the technology disclosed. Various modifications to the disclosed implementations will be apparent, and the general principles defined herein may be applied to other implementations and applications without departing from the spirit and scope of the technology disclosed. Thus, the technology disclosed is not intended to be limited to the implementations shown, but is to be accorded the widest scope consistent with the principles and features disclosed herein. The scope of the technology disclosed is defined by the appended claims.

What is claimed is:

1. An apparatus configured to reduce a force necessary to separate a container from a nested stack of two or more containers, the apparatus comprising:

a partition configured to modify at least one area of contact between an inner container, comprising a hollow cavity, and an outer container;

a first upper support member comprising a flat support surface extending from an upper end of the partition, wherein the first upper support member extends linearly along a plane that is transverse to the plane along which the partition extends;

a second upper support member extending from the first upper support member, wherein the second upper support member extends linearly along a plane that is transverse to the plane along which the first upper support member extends; and a lower support member extending from a lower end of the partition, wherein the lower support member extends linearly along a plane that is transverse to the plane along which the partition extends and wherein a length of the lower support member is less than a length of the second upper support member, and wherein, when the apparatus is installed:

the inner container is nested inside of the outer container with the partition located between an outer surface of a wall of the inner container and an inner surface of a wall of the outer container, the wall of the outer container is located in between the partition and the second upper support member, and the first upper support member is in contact with an upper rim of the outer container.

2. The apparatus of claim 1, wherein the partition modifies the area of contact by restricting one or more size dimensions of the area of contact, adjusting a location of the area of contact, reducing a magnitude of force exerted onto the area of contact, or altering one or more properties related to absorption or distribution of a force exerted onto the area of contact.

3. The apparatus of claim 1, wherein the apparatus is configured to be inserted into the outer container before the inner container is inserted into the outer container as a preventative measure to reduce a potential force necessary for separation before the nested stack is constructed.

4. The apparatus of claim 1, wherein the lower support member is configured to provide additional support for the inner container by restricting a depth of insertion for the inner container into the outer container.

5. The apparatus of claim 1, wherein a length of the partition is greater than the length of the second upper support member, and wherein, when the apparatus is installed, a distance between the lower support member and a bottom portion of the outer container is smaller than a distance between the lower support member and the upper rim of the outer container.

6. The apparatus of claim 1, wherein the upper end of the partition and the first upper support member form an angle between 80 and 100 degrees, inclusive.

7. The apparatus of claim 1, where the first upper support member and the second upper support member form an angle between 80 and 100 degrees, inclusive.

8. The apparatus of claim 1, wherein the lower end of the partition and the lower support member form an angle between 80 and 100 degrees, inclusive.

9. The apparatus of claim 1, wherein the apparatus is configured to provide an applied force against at least one of an adjacent surface of the outer container or an adjacent surface of the inner container in order to prevent at least one of: a reduced volume of a space located between the outer container and the inner container, a seal at least partially forming between a surface of the inner container and a surface of the outer container, and a reduced airflow within an inner cavity of the outer container.

10. The apparatus of claim 1, wherein the apparatus is configured to reduce a mutual friction between a surface of the outer container and a surface of the inner container in order to reduce a realized force necessary to separate the outer container and the inner container.

11. The apparatus of claim 1, wherein the apparatus is configured to reduce a realized force necessary to separate the outer container and the inner container, independently from at least one of: a height, a diameter, or a draft angle of the inner container, a height, a diameter, or a draft angle of the outer container, and a depth of a point of contact between the inner container and the outer container while nested.

12. The apparatus of claim 1, wherein at least one of the partition and the second upper support member does not need to physically contact the outer container in order to modify the area of contact, based at least in part on at least one of (i) the first upper support member being configured to support the apparatus by providing a balanced base relative to a lateral force and (ii) the second upper support member being configured to provide a counterbalance relative to the partition.

13. The apparatus of claim 1, wherein the length of the lower support member is smaller than a length of a diameter of the inner container.

14. The apparatus of claim 1, wherein the lower support member is configured to reduce a force applied onto the outer container based, at least in part, on an area of contact between the outer container and the apparatus.

15. The apparatus of claim 1, wherein the length of the lower support member only partially extends across a diameter of a bottom of the inner container.

16. The apparatus of claim 1, wherein the length of the lower support member is less than a length of the first upper support member.

17. The apparatus of claim 1, wherein the length of the lower support member is less than a length of the partition.

18. An apparatus configured to reduce a force necessary to separate a container from a nested stack of two or more containers, the apparatus comprising:

a partition configured to modify at least one area of contact between an inner container, comprising a hollow cavity, and an outer container;

a first upper support member comprising a flat support surface extending from an upper end of the partition, wherein the first upper support member extends linearly along a plane that is transverse to the plane along which the partition extends;

a second upper support member extending from the first upper support member, wherein the second upper support member extends linearly along a plane that is transverse to the plane along which the first upper support member extends;

a lower support member extending from a lower end of the partition, wherein the lower support member extends linearly along a plane that is transverse to the plane along which the partition extends; and one or more via holes configured to hold a peg, wherein the peg is any structure inserted within a via hole and when the apparatus is installed, the peg provides support for the inner container to stop insertion of a bottom of the inner container within the outer container, wherein, when the apparatus is installed:

the inner container is nested inside of the outer container with the partition located between an outer surface of a wall of the inner container and an inner surface of a wall of the outer container, the wall of the outer container is located in between the partition and the second upper support member, and the first upper support member is in contact with an upper rim of the outer container.

19. An apparatus configured to reduce a force necessary to separate a container from a nested stack of two or more containers, the apparatus comprising:

a partition configured to modify at least one area of contact between an inner container, comprising a hollow cavity, and an outer container;

a first upper support member comprising a flat support surface extending from an upper end of the partition, wherein the first upper support member extends linearly along a plane that is transverse to the plane along which the partition extends;

a second upper support member extending from the first upper support member, wherein the second upper support member extends linearly along a plane that is transverse to the plane along which the first upper support member extends;

a lower support member extending from a lower end of the partition, wherein the lower support member extends linearly along a plane that is transverse to the plane along which the partition extends; and one or more via holes located in the partition, wherein the one or more via holes are configured to receive a peg that forms a lower support member, such that, when the peg and the apparatus are installed, the lower support member receives a bottom portion of the inner container to prevent further insertion of the bottom portion of the inner container, and wherein, when the apparatus is installed:

the inner container is nested inside of the outer container with the partition located between an outer surface of a wall of the inner container and an inner surface of a wall of the outer container, the wall of the outer container is located in between the partition and the second upper support member, and the first upper support member is in contact with an upper rim of the outer container.

* * * * *